United States Patent [19]

Plaza et al.

[11] 4,037,532

[45] July 26, 1977

[54] HAMMER ASSEMBLY

[75] Inventors: Mario G. Plaza, Fremont; Michael C. Weisberg, San Carlos, both of Calif.

[73] Assignee: Xerox Corporation, Stamford, Conn.

[21] Appl. No.: 664,797

[22] Filed: Mar. 8, 1976

[51] Int. Cl.[2] ..... B41J 9/02

[52] U.S. Cl. ..... 101/93.48; 197/49; 173/119; 173/133

[58] Field of Search .... 101/93.02, 93.03, 93.29–93.34, 101/93.48; 197/49, 53, 54, 18, 1 R; 173/119, 133, 135

[56] References Cited

U.S. PATENT DOCUMENTS

| | | | |
|---|---|---|---|
| 2,353,057 | 7/1944 | Mills | 101/93 |
| 3,090,297 | 5/1963 | Wilkins et al. | 101/93.03 |
| 3,117,256 | 1/1964 | Gamblin | 317/166 |
| 3,143,064 | 8/1964 | Vann | 101/93 |
| 3,152,540 | 10/1964 | Pensavecchia et al. | 101/93 |
| 3,184,075 | 5/1965 | McGregor et al. | 101/93 |
| 3,266,419 | 8/1966 | Erpel | 101/93 |
| 3,309,989 | 3/1967 | Solheim et al. | 101/93 |
| 3,517,611 | 6/1970 | Fink | 101/93.31 |
| 3,556,002 | 1/1971 | Bragg | 101/93.33 X |
| 3,633,500 | 1/1972 | Edwards et al. | 101/111 |
| 3,795,187 | 3/1974 | Babler | 101/93.30 |
| 3,960,075 | 6/1976 | Babler | 101/93.48 |

*Primary Examiner*—Edward M. Coren
*Attorney, Agent, or Firm*—M. J. Colitz; T. J. Anderson; B. P. Smith

[57] ABSTRACT

A hammer assembly comprising a housing having opposing open ends and an internal passage extending between the open ends. A hammer element is positioned in the housing for reciprocal movement in the passage between first and second positions. The hammer element has an opening formed therein in which a biasing member is positioned. When enabled, the biasing member is capable of biasing the hammer element in a desired direction relative to the first and second positions. Means are also included for enabling the biasing member when the hammer element is in at least its first position. The housing is desirably fabricated of a self-lubricating material with the area of the opening at one of its ends substantially larger than the cross-sectional area of the hammer element, taken along a plane perpendicular to the axis of motion of the hammer element at such one end in order for air to be freely vented from the passage during reciprocal movement of the hammer assembly.

5 Claims, 4 Drawing Figures

HAMMER ASSEMBLY

CROSS-REFERENCE TO RELATED APPLICATIONS

This application is related to U.S. application Ser. No. 606,981 now abandoned entitled HAMMER FOR PRINT WHEEL, filed in the names of Mario G. Plaza and Alfred G. Osterlund on Aug. 22, 1975 and assigned to the assignee of the present invention, and is also related to U.S. application Ser. No. 606,992 entitled PRINT WHEEL HAMMER, filed in the names of Alfred G. Osterlund and Mario G. Plaza on Aug. 22, 1975 and assigned to the assignee of the present invention.

BACKGROUND OF THE INVENTION

This invention relates to hammer assemblies and, more particularly, to hammer assemblies of the type including a housing having opposing open ends and an internal passage extending between the open ends, a hammer element positioned in the housing for reciprocal movement in the passage between first and second positions, and a biasing member coupled to the hammer element for biasing the hammer element in a desired direction relative to said first and second positions.

Hammer assemblies of the above-type have come into widespread commercial use in machines requiring high speed precision impacting of a desired object to be struck. An example is a high speed serial printer of the type employing a rotatable print wheel having a plurality of character elements extending radially from a central hub. In such printers, the print wheel is rotated until a character element desired for printing reaches a predetermined printing position. Then, the hammer assembly is activated to cause the hammer element thereof to strike the character element causing the imprinting of the character element on a desired recording medium.

U.S. Pat. No. 3,266,419 discloses a hammer assembly used in a serial printer employing a print wheel of the type having character elements formed about its peripheral surface, and U.S. application Ser. No. 505,105 filed on Sept. 11, 1974 in the name of Andrew Gabor and assigned to the assignee of the present invention discloses another hammer assembly used in a serial printer employing a "daisy wheel" type of print wheel where the character elements are formed on spokes projecting outwardly from a central hub.

In each of the above assemblies, the spring member used to hold the hammer element in a retracted position is disposed about the exterior of the hammer element. Not only does this increase the size requirements of the housing, but it also makes assembly difficult and cumbersome. In addition, and in the case of the hammer assembly of U.S. Pat. No. 3,266,419 where the spring member is in direct contact with the hammer element, should the hammer element be metallic like the spring member, corrosion due to prolonged frictional contact can occur.

In the case of hammer assemblies comprised of all metallic components, it is generally necessary to add a lubricant on a regular basis to reduce frictional resistance to movement of the hammer element in the housing, as well as to reduce the likelihood of corrosion. However, the lubricant has a tendency to collect dirt which can clog up the passage in which the hammer is disposed thereby hampering effective operation. Substantial clogging can retard the exhaust of air during reciprocal movement of the hammer element thereby resulting in a "piston effect" which can all but eliminate effective operation.

Certain hammer assemblies, such as the one disclosed in the aforementioned U.S. application Ser. No. 505,105, suffer from another deficiency, i.e. the impacting surface area of the hammer tip is not large enough to cover the full spread of character elements. This deficiency, the potential problems it engendures and a desired solution thereto are disclosed in the aforementioned U.S. application Ser. No. 606,981. Generally speaking, the desired solution resides in the provision of a "taller" hammer element having a specifically configured hammer tip. With such a taller hammer, it is clear that if the spring member continued to be disposed about the exterior of the hammer element, it would have to be of substantially larger size than that employed in the hammer assembly disclosed in U.s. application Ser. No. 505,105, thereby significantly reducing its effectiveness and adding to the overall size and cost of the assembly.

It would be desirable, therefore, to utilize the hammer element disclosed in the aforementioned U.S. application Ser. No. 606,981 in a hammer assembly where the various disadvantages and drawbacks of the prior art hammer assemblies discussed above would be substantially reduced or eliminated.

SUMMARY OF THE INVENTION

In accordance with one aspect of the present invention, a hammer assembly is provided comprising a housing having opposing open ends and an internal passage extending between said open ends, a hammer element positioned in said housing for reciprocal movement in said passage between first and second positions, said hammer element having an opening formed therein, a biasing member positioned in said opening and capable when enabled of biasing said hammer element in a desired direction relative to said first and second positions, and means for enabling said biasing member when said hammer element is in at least said first position.

By disposing the biasing member, preferably a helically wound spring, in an opening in the body of the hammer element itself, the diametric dimension of the sring is kept relatively small thereby reducng the size requirements of the housing and increasing the effectiveness of the spring. Further, and in accordance with the preferred embodiment, the diameter of the spring is smaller than the vertical extent of the opening so as to reduce the frictional contact of the spring and hammer element during reciprocal movement of the latter, thereby reducing the possibility of corosion.

In accordance with another aspect of the present invention, the housing is fabricated of a self-lubricating material in order to eliminate the need for lubrication and its inherent disadvantages as discussed earlier.

In accordance with still another aspect of the present invention, the area of the opening at one end of the housing is substantially larger than the cross-sectional area of the hammer element taken along a plane perpendicular to the axis of motion of the hammer element at said one end of the housing. With this relationship, air is freely vented from the housing passage during reciprocal movement of the hammer element thereby eliminating any "piston effect" occurrence.

These and other aspects and advantages of the present invention will be more completely described below with reference to the accompanying drawings.

DESCRIPTION OF THE PREFERRED EMBODIMENT

Figure 1:
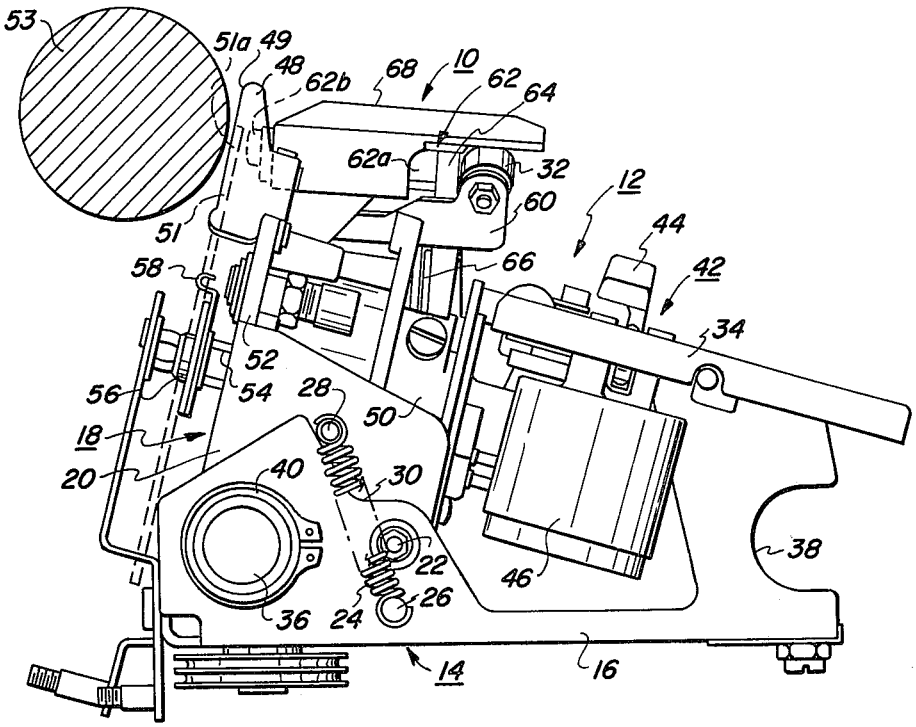
FIG. 1 is a side elevation view of an exemplary carriage assembly of a serial printer having mounted thereon a "daisy wheel" type print wheel (shown in phantom) and a hammer assembly of the present invention, and being adapted to carry a ribbon cartridge (not shown) in operative relation to the print wheel and hammer assembly.

A hammer assembly 10 in accordance with the present invention is shown in FIG. 1 mounted to a carriage assembly 12 of the general type disclosed in the aforementioned U.S. application Ser. No. 505,105. The carriage assembly 12 is thus adapted to transport not only the hammer assembly 10, but also a rotatable print wheel 51 of the "daisy wheel" type (shown in phantom) and a ribbon cartridge (not shown) to selected printing positions along a predefined linear path parallel to the axis of a cylindrical support platen 53.

Referring specifically to FIG. 1, the carriage assembly 12 comprises an outer carriage member 14 having opposing side walls 16 (only one visible) and an inner carriage member 18 also having opposing side walls 20 (only one visible) and a front wall 52. The inner carriage member 18 is pivotably mounted at its side walls 20 to the side walls 16 of the outer carriage member 14 by means of a suitable pivot bolt 22 extending through the side walls 16 and 20. Coupled between each pair of adjacent side walls 16 and 20 is a spring member 24 (only one visible). Specifically, each spring member 24 is attached in tension between a pair of pin-like members 26 and 28 respectively projecting from the associated side walls 16 and 20. Each spring member 24 is desirably "over-centered" in the sense that its center of mass is positioned above the axis of the pivot bolt 22. In this manner, the spring members 24 will exert a forward and downward force when they are positioned forwardly of the bolt 22 in the manner shown in FIG. 1, and a rearward and downward force when they are positioned rearwardly of the bolt 22.

The inner carriage member 18 is capable of being pivoted between two positions. The first, shown in FIG. 1, is defined when each pin-like member 28 engages an inclined portion of the upper surface 30 of the adjacent side wall 16 of outer carriage member 14. The inner carriage member is retained in this first position due to the biasing action of the spring members 24 as described above. In a second pivotal position (not shown), the inner carriage member 18 is pivoted clockwise until a hammer stop 32 mounted thereto and to be described in more detail below engages a pivot shaft 35 through an opening (not shown) in a ribbon cartridge base plate 34 mounted to a rearward portion of the side walls 16 of the outer carriage member 14. Again, the inner carriage member 18 will be retained in this second position due to the biasing action of the spring members 24. In the second pivotal position, the print wheel 51 can be removed and replaced with another, whereas in the first pivotal position, the print wheel 51 is brought into operative positional relation relative to the platen 53.

As shown in FIG. 1, the outer carriage member 14 has a pair of aligned openings 36 formed in the respective side walls 16 adjacent the front end of the carriage assembly 12 and a pair aligned recesses 38 formed in the respective side walls 16 adjacent the rear end of the carriage assembly. The openings 36 are adapted to receive in locked relation a linear bearing assembly 40 which is preferably of the type disclosed in U.S. application Ser. No. 588,995 filed on June 20, 1975 in the names of Mario G. Plaza and Richard D. Trezise for CARRIAGE SUPPORT APPARATUS and assigned to the assignee of the present invention. A similar bearing assembly (not shown) is adapted to be secured in the recess 38. As described in the aforementioned U.S. application Ser. No. 588,995, the linear bearings are designed to ride along carriage rails so that the carriage assembly 12 may be transported to desired printing positions along a predefined linear path.

Mounted to the outer carriage 14 is a ribbon cartridge support and drive assembly 42 which includes the base plate 34 alluded to above, as well as a pair of latches 44 (only one visible) for locking a suitable ribbon cartridge (not shown) in position on the base plate 34. Additionally, the support and drive assembly 42 includes a ribbon drive motor 46 for forwarding ribbon along a path from the ribbon cartridge, along and in front of a pair of ribbon guides 48 (only one visible) mounted to the front wall 52 of the inner carriage 18, and then back into the ribbon cartridge. An exemplary ribbon cartridge that may be mounted to and used with the carriage assembly 12 is disclosed in U.S. application Ser. No. 633,530 filed on Nov. 19, 1975 in the names of Mario G. Plaza and Richard D. Trezise for DUAL LEVEL RIBBON CARTRIDGE and assigned to the assignee of the present invention.

A print wheel motor 50 is also mounted by suitable means (not shown) to the front wall 52 of the inner carriage member 18 for controlling the speed and direction of rotation of the print wheel 51 in order to bring a desired character element **51*a* on the wheel to a stationary printing position in alignment with the platen 53 and the tip of a hammer element 62 included in the hammer assembly 10. The motor 50 has a spindle 54 projecting forwardly of the wall 52. A hub portion 56 forms part of the spindle and is adapted to be received in the central opening (not shown) of the "daisy wheel" type print wheel 51. An exemplary print wheel of this type is generally disclosed in the aforementioned U.S. application Ser. No. 505,105. In order to prevent the print wheel 51 from moving relative to the spindle 54 during rotation thereof by the motor 50, a key member 58 forms part of the spindle and is adapted to be inserted in a keyway (not shown) included in the print wheel 51** (see again the print wheel disclosed in U.S. application Ser. No. 505,105).

Also mounted to the front wall 52 of the inner carriage 18 is the hammer assembly 10 of the present invention, as well as a stop arm 60 having the hammer stop 32 bolted thereto. Interposed between the stop 32 and the rear end of the hammer element 62 is an armature 64 which forms part of a conventional electromagnetic actuating assembly 66. The armature 64 is normally in the position shown in FIG. 1 until the electromagnet assembly is actuated, at which time the armature is forced forwardly. As will be described in more detail below, such forward movement of the armature 64 results in the free flight forward movement of the hammer element 62. The hammer element will continue to "fly" forwardly until its front end, or tip, contacts the aligned character element 51*a* on the print wheel 51 and forces it and any ribbon (not shown) disposed in front of the wheel on the guides 48 against a recording medium (not shown), such as paper, supported on the platen 53. In this regard, and as shown in FIG. 1, the platen 53 is positioned adjacent and forwardly of the print wheel 51 in alignment with the character element element 51*a* and the hammer element 62.

Figure 2:
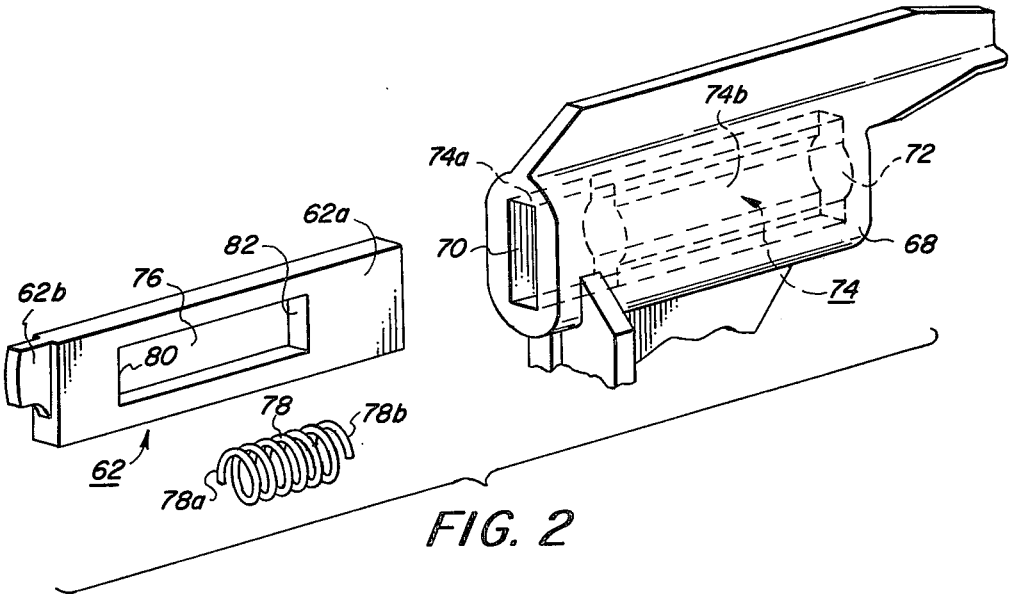
FIG. 2 is an exploded perspective view of the hammer assembly of FIG. 1.
Figure 3:
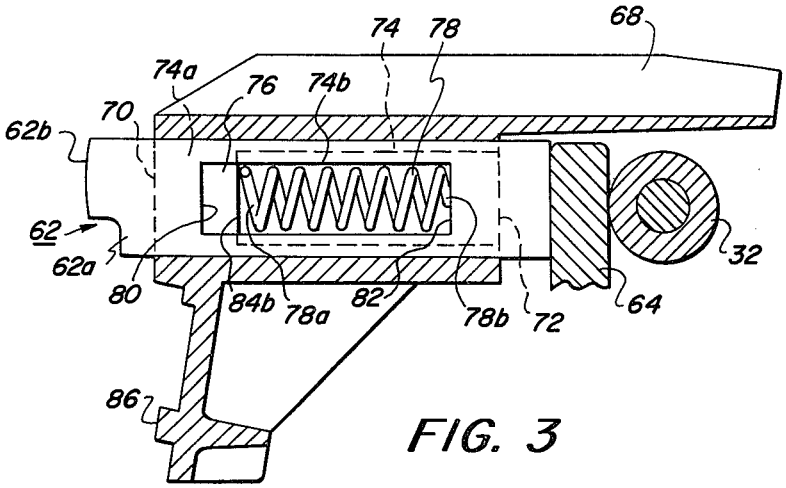
FIG. 3 is a cross-sectional view of the hammer assembly of FIG. 1.
Figure 4:
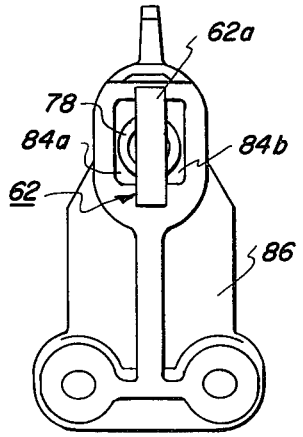
FIG. 4 is an end view of the hammer assembly of FIG. 2.

Reference is now had to FIGS. 2–4 where the hammer assembly 10 will be described in more detail. As shown, the hammer assembly 10 includes a housing 68 having opposing open ends 70 and 72 and an internal passage 74 extending between the open ends 70 and 72. The hammer assembly 10 further includes the hammer element 62 which is positioned in the housing 68 for reciprocal movement in the passage 74 between a first position shown in FIG. 1, where the hammer element 62 is spaced apart from the print wheel 51, and a second position (not shown) forwardly of the first position and corresponding to the hammer element impacting a character element on the print wheel 51 against the adjacent support platen 53.

As best shown in FIG. 2, the hammer element 62 is preferably of the type disclosed in the aforementioned U.S. application Ser. No. 606,981 and is, therefore, formed of a main body portion 62*a* and a tip portion 62*b* extending forwardly of the main body portion 62*b.* The specific configuration of the tip portion 62*b* forms no part of the present invention and thus will not be described in detail herein. However, a complete description of the tip portion 62*b* can be found in U.S. application Ser. No. 606,981.

Referring now to the main body portion 62*a* of the hammer element 62, it will be noted that it is of generally uniform rectangular cross-sectional shape along its axis of motion with a slot-like opening 76 formed therein for receiving a biasing member 78 in a manner to be described in more detail below. The biasing member 78 is desirably a helically wound spring which, when enabled in a manner also to be described below, is capable of biasing the hammer element 62 in the direction of the hammer stop 32 (FIG. 1).

As shown in FIGS. 2 and 3, the internal passage 74 has a forward portion 74*a* and a rearward portion 74*b.* The forward portion 74*a* preferably has a uniform cross-sectional shape along its longitudinal axis with the area of such cross-section being equal to the area of the opening in end 70 of the housing and just slightly larger than the cross-sectional area of the portion of the hammer element 62 disposed in such forward portion 74*a.* Desirably, only the main body portion 62*a* of the hammer element 62 is disposed in forward portion 74*a* in either of its above-mentioned first and second positions. The cross-sectional area of the hammer element above referred to is taken along a plane perpendicular to its axis of motion at end 70. The cross-sectional area of the forward portion 74*a* is preferably only greater than that of the hammer element portion 62*a* disposed therein by an amount sufficient to allow the free reciprocal movement of the hammer element 62.

The rearward portion 74*b* of the passage 74, like forward portion 74*a,* also is preferably of uniform cross-sectional shape along its longitudinal axis. The area of such cross-section is equal to the area of the opening in end 72 of the housing and is substantially larger than the cross-sectional area of the main body portion 62*a* of the hammer element disposed therein, such latter cross-sectional area being taken along a plane perpendicular to the axis of motion of the hammer element at end 72. The cross-sectional area of the rearward portion 74*b* is made only slightly larger than the diameter of the spring 78 so as to allow free reciprocal movement of the hammer element and spring, but not so large that the spring could slip out of the opening 76. The diameter of the spring 78 is necessarily larger than the width-wise extent of the main body portion 62*a* of the hammer element and is preferably smaller than the vertical extent of the opening 76 for reasons which will become clear below.

Among the reasons for forming the rearward portion 74*b* of passage 74 and the opening in end 72 with a substantially larger cross-sectional area than that of the forward portion 74*a* and opening in end 70 are that the hammer element 62 with spring 78 mounted therein can be loaded into the housing from the rear, thereby facilitating overall assembly, and that the larger opening enables air in the housing to be freely vented during reciprocal movements of the hammer element, thereby avoiding a "piston effect" occurrence. The precise manner in which the hammer element is moved forwardly, returned and retained in a retracted position, i.e. its first position above defined, will be discussed in more detail below.

Referring now to the manner in which the hammer assembly 10 is assembled, the first step is to load the spring 78 in the opening 76 with opposing ends 78*a* and 78*b* of the spring being forced against the opposing interior walls 80 and 82 of the housing defining the opening 76 (see FIG. 3). In this respect, the length of the spring when in a stable (non-compressed and non-tensioned) condition is slightly larger than the length of the opening 76 so that the spring 78 will be in compression when placed in the opening 76 in the above manner and retained therein.

The spring 78 is desirably positioned in the opening 76 with its circumferential periphery, as opposed to its ends 78*a* and 78*b,* out of engagement with the hammer element (see FIG. 3). This is possible in view of the diameter of the spring being slightly less than the vertical extent of the opening 76. This "floating" of the spring reduces the chances of rubbing contact during reciprocal movement of the hammer element 62 thereby reducing the possibility of corrosion.

The next step in the assembly process is to load the hammer element 62 and spring 78 into the housing 68 through the opening 72. Free forward movement of the hammer element can occur until the forward end 78*a* of the spring, portions of which extend outwardly from the sides of the hammer element due to the larger diameter of the spring 78 relative to the widthwise extent of the hammer element, contacts a pair of walls 84*a* and 84*b* (see FIGS. 3 and 4) formed in the housing at the boundary of the forward portion 74*a* and rearward portion 74*b* of the passage 74.

As a next step, the housing 68 is mounted to the inner carriage member 18. This is accomplished by screwing or bolting a mounting bracket portion 86 of the housing to the front wall 52 of the inner carriage member 18. By reason of the predetermined spacing between the armature 64, in its normal inactuated position abutting stop 32, and the front wall 52, it is necessary to force the hammer element 62 a predetermined distance forwardly of the location of initial contact of the spring end 78*a* with walls 84*a* and 84*b* so that the hammer element can be disposed in front of the armature with its rear end abutting same. In this position, the spring 78 is further compressed between the walls 84*a*–84*b* at end 78*a* and the wall 82 at end 78*b* thereby establishing a biasing force tending to move the hammer element rearwardly, i.e. toward the stop 32. The hammer element will, of course, be restrained from such movement due to its abuttment against armature 64 and stop 32.

On the basis of the above, it may be said that the hammer assembly includes means, in the form of the walls 84*a* and 84*b*, for cooperating with the armature 64 and stop 32 to bias the hammer element 62 rearwardly when it is in at least its first, or retracted position. In the preferred embodiment depicted in the drawings, the biasing force will, of course, be present and increase when the hammer element 62 is forced forwardly by actuation of the armature 64 to strike the aligned character element 51*a* on the print wheel against the platen 53.

It should be clear from the above, and in accordance with one aspect of the present invention, the inclusion of the spring 78 within the body of the hammer element 62 itself not only greatly reduces the size requirements of the spring, thereby increasing its effectiveness, but also reduces the overall size requirements of the housing 68 and thus assembly 10.

In accordance with yet another aspect of the invention and in an effort to eliminate the need for periodic lubrication of the hammer assembly 10, the housing is preferably fabricated of a self-lubricating material, such as fluorocarbon filled thermoplastic. Thus, the disadvantages attributed to using a lubricant, as discussed earlier, are essentially eliminated.

In operation, when a desired character element 51*a* on the print wheel 51 has been rotated by the print wheel motor 50 into a predetermined printing position in alignment with the hammer element 62, and the desired linear position of the carriage assembly has been reached, the electromagnetic assembly 66 is actuated to thrust the armature 64 forwardly, thereby causing the free-flight movement of the hammer element 62 in the direction of the platen 53. Of course, the thrusting force supplied by the armature 64 will be greater than the biasing force supplied by the spring 78 by an amount sufficient to enable the hammer element 62 to strike the character element 51*a* against the platen 53 with the desired intensity.

Once the hammer element strikes the selected character element 51*a* against the platen 53, the ensuing semi-elastic collision forces the hammer element 62 back in the direction of the armature 64 and stop 32 where it will eventually impact. In order to prevent any significant rebound of the hammer element 62 in the direction of the platen 53 following impact against the armature 64 and stop 32, the stop is preferably fabricated of a "non-bounce", or energy absorbing, material. Additionally, the biasing force established by the spring 78 contributes to a retention of the hammer element in a retracted position following impact against the armature 64 and stop 32. When the hammer element finally comes to rest in its retracting (first) position (FIGS. 1 and 3), the biasing action of the spring 78 holds it there until the next actuation of armature 64 by assembly 66.

Although the present invention has been described with reference to a presently preferred embodiment, it will be appreciated by those skilled in the art that various modifications, substitutions, etc. may be made without departing from the spirit and scope of the invention as defined in and by the following claims.

What is claimed is:

1. A hammer assembly comprising:

a housing having opposing ends and an internal passage extending between said open ends, said passage including a forward portion adjacent the other end of said housing and a rearward portion adjacent the other end of said housing, said forward and rearward portions each being substantially uniform in cross-sectional area along the longitudinal axis of said housing, said cross-sectional area of the forward portion being less than said cross-sectional area of the rearward portion;

a hammer element positioned in said housing for reciprocal movement in said passage between forward and rearward positions, said hammer element having an opening formed therein;

a biasing member positioned in said opening and capable when enabled of biasing said hammer element in the direction of its rearward position, said biasing member comprising a helically wound spring compressed when not enabled between a pair of opposing walls of said hammer element defining the forward and rearward ends of said opening, said spring having a diameter greater than said cross-sectional area of the forward portion of said passage and less than said cross-sectional area of the rearward portion of said passage; and means for enabling said spring when said hammer element is in at least its forward position, said means for enabling comprising wall means forming part of said housing and being located substantially at the boundary of the forward and rearward portions of said passage for engaging one end of said spring and preventing its movement toward the end of said housing adjacent the forward portion of said passage whereby continued forward movement of said hammer element causes said spring to be further compressed between said wall means at said one end of said spring and one of said pair of opposing walls at the other end of said spring thereby biasing said hammer element in a rearward direction.

2. The hammer assembly of claim 1, wherein said hammer element comprises a main body portion including said opening formed therein and a tip portion extending from one end of said main body portion.

3. The hammer assembly of claim 2, wherein said cross-sectional area of the rearward portion of said passage is larger than the cross-sectional area of said main body portion taken along a plane perpendicular to said longitudinal axis of the housing at said other end of the housing whereby air is vented from said passage during reciprocal movement of said hammer element.

4. The hammer assembly of claim 1, wherein said opening is generally rectangular in shape having its elongate extent along the axis of motion of said hammer element.

5. The hammer assembly of claim 1, wherein said housing is fabricated of a self-lubricating material.

* * * * *